US005368521A

United States Patent [19]

Koenig

[11] Patent Number: 5,368,521

[45] Date of Patent: Nov. 29, 1994

[54] FLUID DISTRIBUTOR FOR STRATIFIED MIXING OF AIR STREAMS

[76] Inventor: Robert P. Koenig, 1720W-115 Cir., Westminster, Colo. 80234

[21] Appl. No.: 22,763

[22] Filed: Feb. 24, 1993

Related U.S. Application Data

[63] Continuation-in-part of Ser. No. 881,706, May 12, 1992, abandoned.

[51] Int. Cl.[5] ..... F24F 13/04

[52] U.S. Cl. ..... 454/261; 454/265; 454/269

[58] Field of Search ..... 454/261, 265, 269

[56] References Cited

U.S. PATENT DOCUMENTS

| | | | |
|---|---|---|---|
| 1,395,938 | 11/1921 | Barducci | 454/269 |
| 2,396,208 | 3/1946 | Serre et al. | 454/261 X |
| 2,400,617 | 5/1946 | Wheller | 454/269 X |
| 2,825,274 | 3/1958 | Kurth et al. | 454/261 |
| 3,386,366 | 6/1968 | Economides et al. | 454/269 X |

*Primary Examiner*—Harold Joyce
*Attorney, Agent, or Firm*—John P. Halvonik

[57] ABSTRACT

A novel plenum chamber and system for the mixing and subsequent distribution of two different fluids. In the preferred example the fluid is air and the chamber mixes fresh and recycled air proportionately and subsequently distributes the air stream through buildings, etc. The plenum chamber is in connection with an fresh air inlet duct and a recirculated air inlet duct at opposite ends, and an outlet duct along a third side. Louver panels divide the chamber into passages that are connected to one of the two intake ducts, the passages alternate being in connection with one or the other of the intake ducts so as to create a stratified mixture of air layers, alternating fresh layer, recirculated layer, etc. chambers. The outlet section is in connection with a distribution fan for dispersal to the rest of the building.

4 Claims, 5 Drawing Sheets

FLUID DISTRIBUTOR FOR STRATIFIED MIXING OF AIR STREAMS

This is a continuation-in-part of application Ser. No. 881,706, filed May 12, 1992, abandoned.

FIELD OF INVENTION

BACKGROUND OF THE INVENTION

The invention relates to the field of air distribution in building structures and in particular to a plenum chamber with a series of parallel placed louver baffles for the variable intake of fresh and recirculated air. The chamber provides for a more nearly equal dispersement of fresh and recirculated air prior to intake by displacement fans which then disperse a fully mixed air flow to all parts of the building.

The object of the invention is to substantially alleviate the sick building syndrome found in many office buildings today. Recirculate air from inside the building needs to be recirculated with outside air in order to keep it relatively fresh. Fans used today, such as centrifugal fans, found in air distribution systems do some mixing but far less than generally estimated. It is not uncommon where two horizontal air strata of different temperatures enter a double inlet squirrel cage fan the discharge will display three vertical strata, with the two outside of nearly the same temperature and the center strata will be of significantly different temperature. A single inlet fan will display a similar phenomenon.

Air in large buildings must be continually mixed with fresh air from the outside in order to keep it fresh and prevent harmful odors, bacteria, etc. from building up in stagnant air streams. Plenum chambers typically draw from a fresh source of air and recirculated source of air, mix the two streams as thoroughly as possible and then pump the resulting air streams throughout the building. As mentioned above, prior art systems may not adequately mix these two streams. Since one side of the plenum chamber is in connection with one type of air (say fresh) and the other side is in connection with another type (say stale) one side of the outlet duct will contain proportionately more of one type of air than the other type.

As each side of the outlet chamber is connected to various passages leading to rooms in the building, one set of rooms on one side of the building will receive one type of air at the expense of the other. One of these sides recieve primarily recirculated air and this leads to possible illness among the occupants due to contaminant buildup, odors, etc. Hence the term: "sick building syndrome."

DESCRIPTION OF THE PRIOR ART

While dampers and mixing boxes are known generally, none that applicant is aware of are dipsosed for the purpose of mechanically creating and maintaining separate parallel streams of outside and recirculated air across the full length and width of a dedicated chamber prior to entering a common plenum for the purpose of mixing. The inherent problem associated with prior art methods is failure to create adequate interface area betwen the strata to facilitate mxiing prior to dispersment to the building. Hence, disproportionate amounts of outside and recirculated air are dispersed to various parts of the system.

SUMMARY OF THE INVENTION

The invention is a plenum chamber for the homogeneous mixing of two different fluid streams. In the preferred embodiment the two streams are fresh air and recirculated air and the chamber finds application in the field of air flow in buildings. Inlet air ducts for the separate streams are located on opposite side of the plenum chamber. An outlet duct is in connection with both air streams and is on third side of the chamber. An alternating series of partitions and louver panels divide the air flow into a series of layers that alternate fresh and recirculated air. Both types of air (or other fluid) are now thoroughly distributed in layers across the width of this chamber and are drawn by a fan (in connection with the outlet duct) and distributed by other ducts to the various parts of the building. The arrangement of alternating layers of two air gases provides for a more complete mixing of the two types of inlet airs for distribution throughout the building.

It is an object of the invention to provide a plenum chamber for intaking two separate fluid streams and outletting a mixed, homogeneous mixture in a most efficient manner.

Another object of the invention is to substantially eliminate "sick building syndrome" by mixing fresh and recirculated air in stratified layers across the width of a plenum chamber in order to make the mixture as homogeneous as possible.

Yet another objective is to provide a plenum chamber that stratifies two separate fluid streams and provides maximum surface contact among the stratified mixtures in order to rapidly diffuse temperature, pollutants, particles, etc.

Other objectives of the invention will become apparent to those skilled in the art once the invention has been shown and described.

DESCRIPTION OF THE PREFERRED EMBODIMENT

The system of louver panels and baffles to be presently described may find utility in proportionately mixing two different fluid streams for distribution as one, thoroughly mixed, fluid stream. The fluids contemplated could come from a number of sources and include but are not limited to: air, water, gases, etc. The term "fluids" is meant to encompass both gases and liquids.

The basic principle should be clear enough to those skilled in the art to allow for a wide variety of applications in different fields. The two fluid streams could of course, vary in many characteristics among them: the temperature of each, the proportion of pollutants, odors, etc. Toward this end, it is desirable to stratify the streams in a direction parallel to one another so as to promote maximum surface contact between the stratified layers in order to make a completely homogeneous mixture. The result will be uniform temperature; uniform percentage pollutants; uniform particle distribution; etc.

Figure 1:
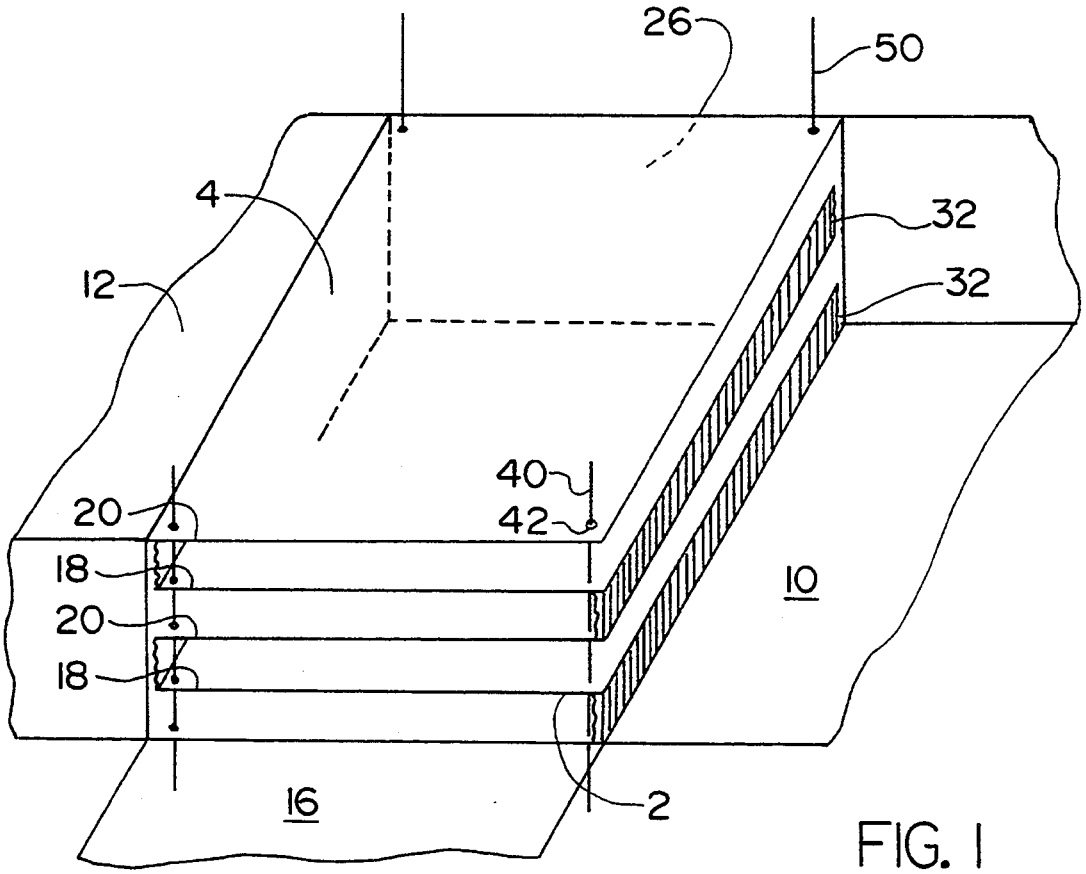
FIG. 1 Cross section of the plenum seen from the outlet duct.
Figure 5:
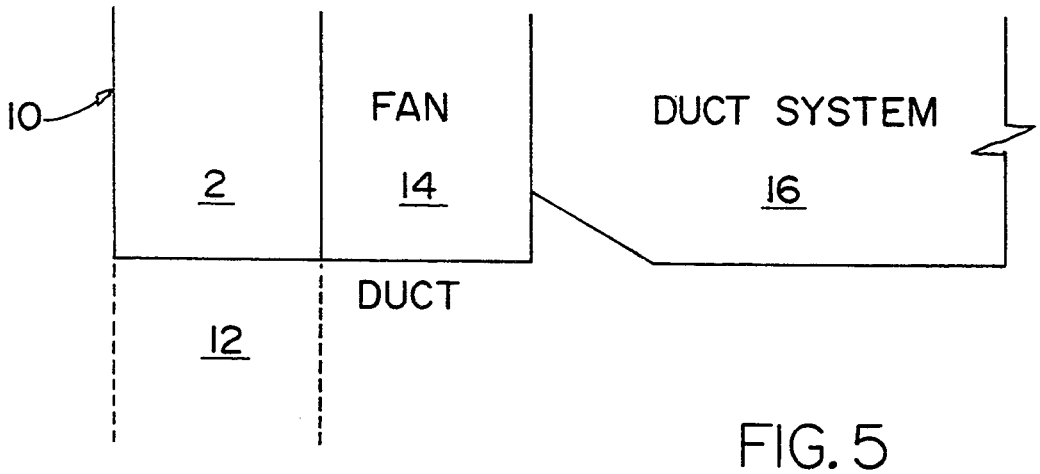
FIG. 5 Top view of overall system.
Figure 2:
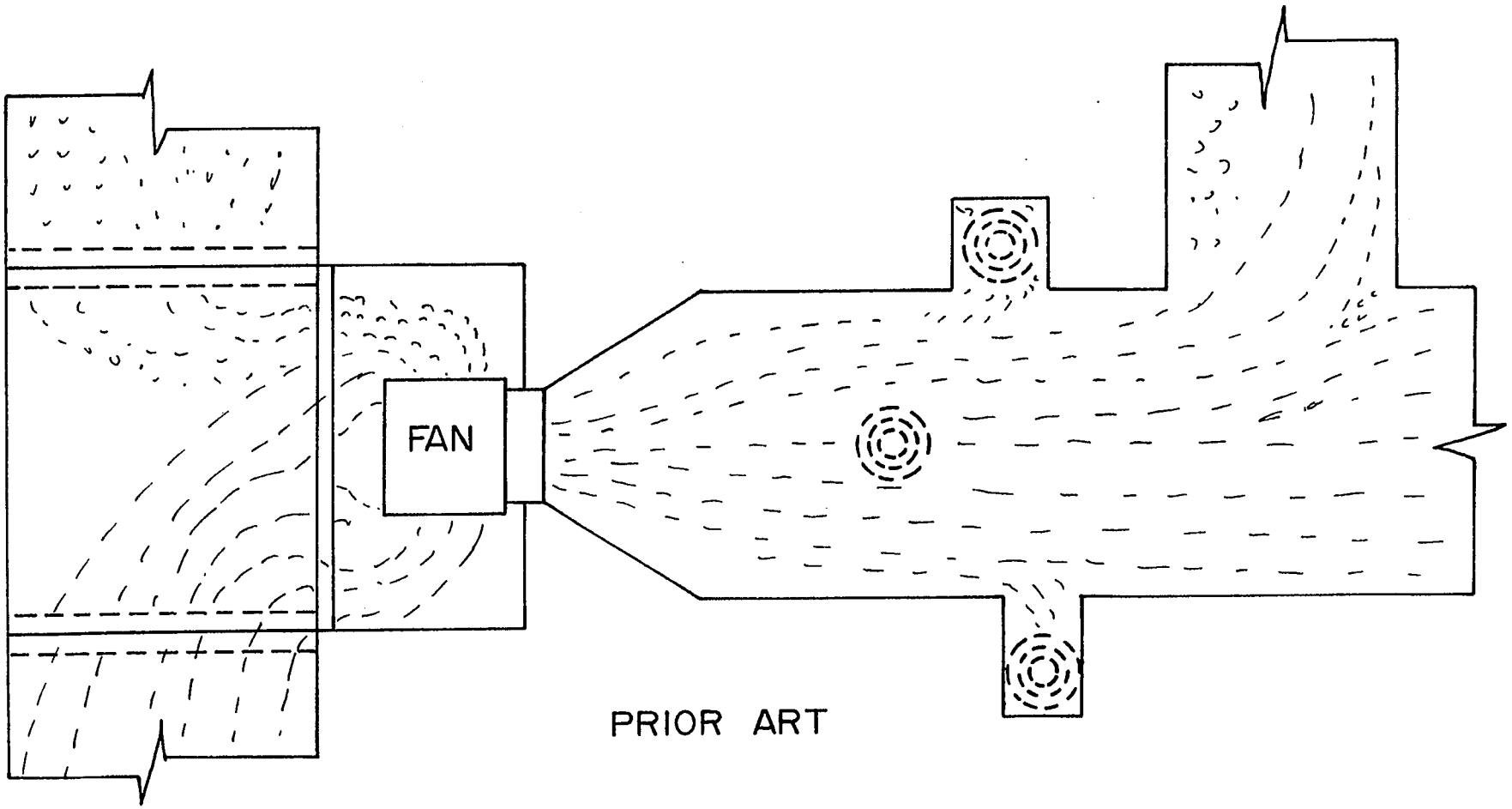
PRIOR ART FIG. 2
FIG. 2 Typical air patterns in prior art air distribution systems.

The overall construction of the system may be sectional and modularized to accommodate a variety of system design requirements. A typical system is shown in FIG. 1. The plenum 2, see FIG. 1, may be viewed as a box with several openings and several walled sides. There are two inlet duct openings 10 and 12 for the inletting of fresh (outside) air and recirculated air in the situation where the plenum is used to distribute air in buildings. These openings are on two sides of the chamber. Along a third side is an opening for the mixing chamber 16 which is also closely connected to the outlet duct, they in fact may be one and the same. Opposite the third side is the back side wall 26. (In embodiment shown in FIG. 4 the back wall would be 60 and would be at a different angle to the outlet duct.) Top and bottom walls 4 and 6 enclose the other sides of the plenum. The top and bottom walls will be used further as reference for orientation of the layers of air and the louvers.

Figure 4:
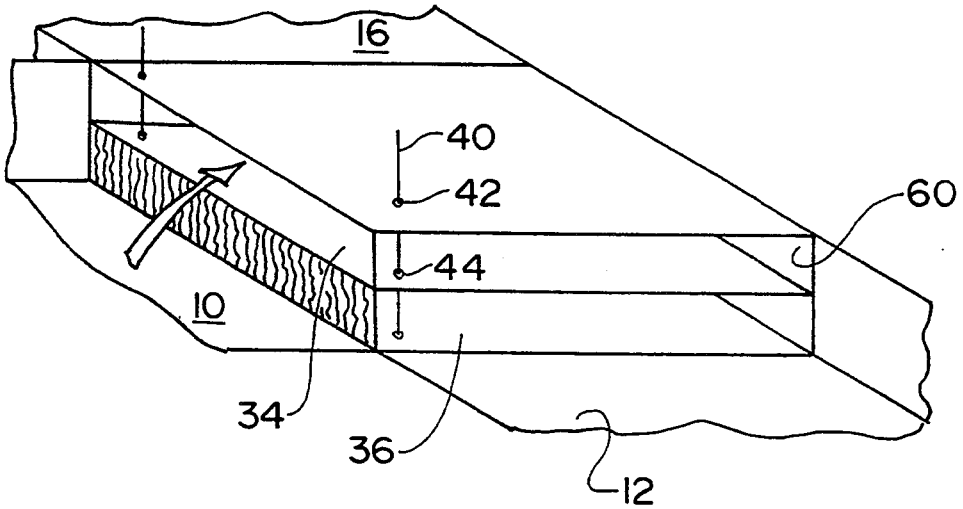
FIG. 4 Plenum chamber with inlet streeams oriented at 90° to one another.

While in the preferred embodiment the two inlet streams are on opposite sides of the plenum, it should be pointed out that it is not necessary in this system for both air inlet streams to be on opposite sides of the plenum. It is possible that one stream may be on one side and the other could be coming in from the front or the back side. See FIG. 4 which details one chamber in this alternate arrangement. Of course this means the two streams could come into the plenum as top and bottom, back and side, side and side, etc. If the inlet ducts are designated on these sides, then the outlet duct would be in connection with the front side of the chamber. In FIG. 4 the inlet configuration is side-back and the outlet is on the front wall of the chamber. In this case, the side wall 60 is solid and inaccessible for air.

20 is a fixed partition, 18 is a movable louvre. Both serve to divide the plenum chamber into parallel passages, 34 and 36, see FIGS. 10 and 4. The parallel partitions are fixed (in contrast to the louver panels which move) and prevent contact with the other interior chambers and thus none of the chambers are in fluid connection with one another. Meaning, of course, that air does not migrate between the partitions in the plenum chamber. Within each chamber is a panel (or louver panel) 18 disposed for movement which further divides each chamber into two inner passages 34 and 36, one in connection with the fresh air inlet duct 12 and one in connection with recirculated air through duct 10. These inlet ducts are preferably on opposite sides of the plenum chamber.

One end of each of the panels 18 (say the end near the inlet duct 10) is in connection with a curtain 32 that prevents inlet air from entering, say, the area above the panel, see FIG. 1. The other end of the panel (say the end near the inlet duct 12) is in connection with a second curtain that prevents inlet air from entering the area below the panel. If the first curtain prevents passage to the area above the panel, then the second curtain would prevent passage to the area below panel, and vice versa. In this manner, the inlet air duct is limited to entering the interior chamber 34 on one side of the panel and the other inlet air duct enters the interior chamber 36 on the other side of the panel.

Thus, the movement of the panel controls the proportions of the two air streams, for example: the position of the louver panels may provide for 80% fresh, 20% recirculated air in each of the chambers. Similar proportions of course prevail at other settings, e.g. 50%–50%, 30%–70%, etc. If x is the proportion of the opening on one side (say the fresh air inlet duct) then $1-x$ will be the proportion of the opening on the other side (say the recirculated air inlet duct).

The invention contemplates a series of movable panels 18. The set of movable panels may be termed a "louver" with the understanding that the panels should generally be disposed to move parallel to one another so that the proportions of fresh air to return air in each of the chambers will all be the same or nearly so.

Both types of inlet air are divided along planes roughly parallel to one another within these chambers 34 and 36. These layers would be roughly parallel to the top wall and bottom wall of the plenum chamber. The layers will alternate fresh, recirculated, etc. since each baffle divides the chamber 26 in two passages, one in connection with the fresh inlet and the other in connection with the recirculated air inlet.

There is a common air duct 16 on a third side of the plenum and may also be referred to as the mixing chamber. The mixing chamber goes across all the chambers and can be seen in FIG. 1 as it is in common with all the layers of air, the layers are then stratified within the chamber. The air is of course drawn into the mixing chamber by fan 14.

The stratified air is actually a series of alternating layers of fresh air and recirculated air. These layers are thought to provide for a more equal distribution of air as it leaves the plenum and is drawn by the fan 14. The stratified layers disperse the different inlet airs (fresh and recirculated), in a sense, across the width of the outlet duct so that both sides of the outlet duct and hence both sides of the building will get approximately equally proportionate amounts of fresh and recirculated air.

Figure 3:
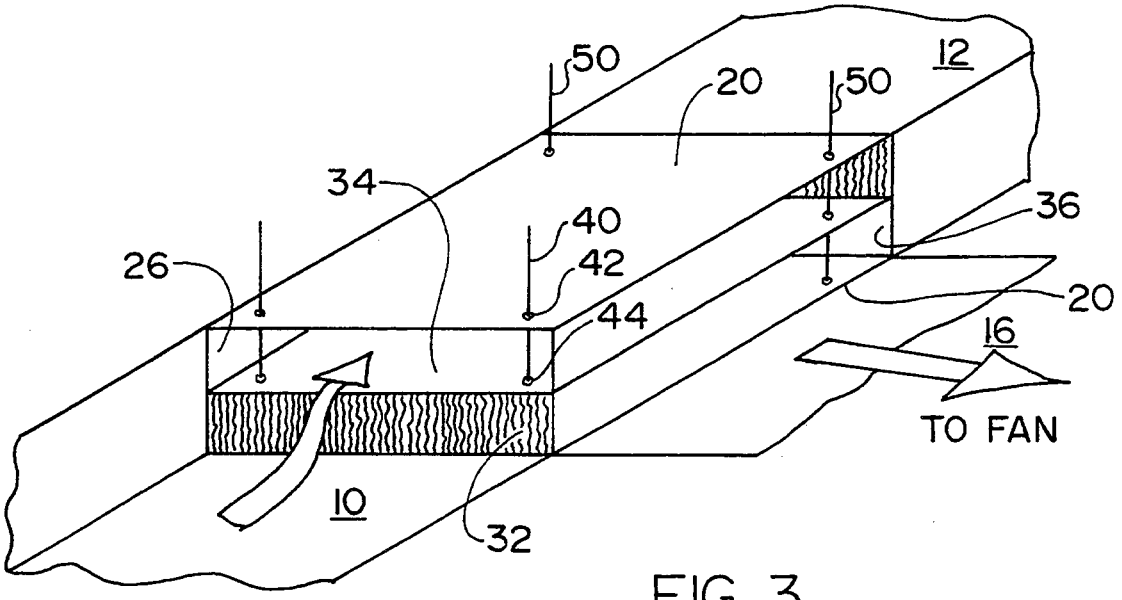
FIG. 3 Shows the plenum with inlet streams oriented at 180°.

One type of system for moving the panels is shown in FIGS. 3 and 4. A rod 40 or other type of actuating means is in contact with all the panels at a point 44. Movement of the rod moves all the panels the same amount so that, for example, the panels may be moved to create a 70% opening on the fresh air side of all the chambers with a corresponding 30% opening on the recirculated side of all the chambers. The size of the opening may be continuously varied, of course. There is an opening 42 in each of the partitions to allow the rods to connect with all the louver panels. A second set of rods 50 may be in connection with the opposite end of each panel in order to facilitate the opening of the other inlet duct, see FIG. 3.

Figure 6:
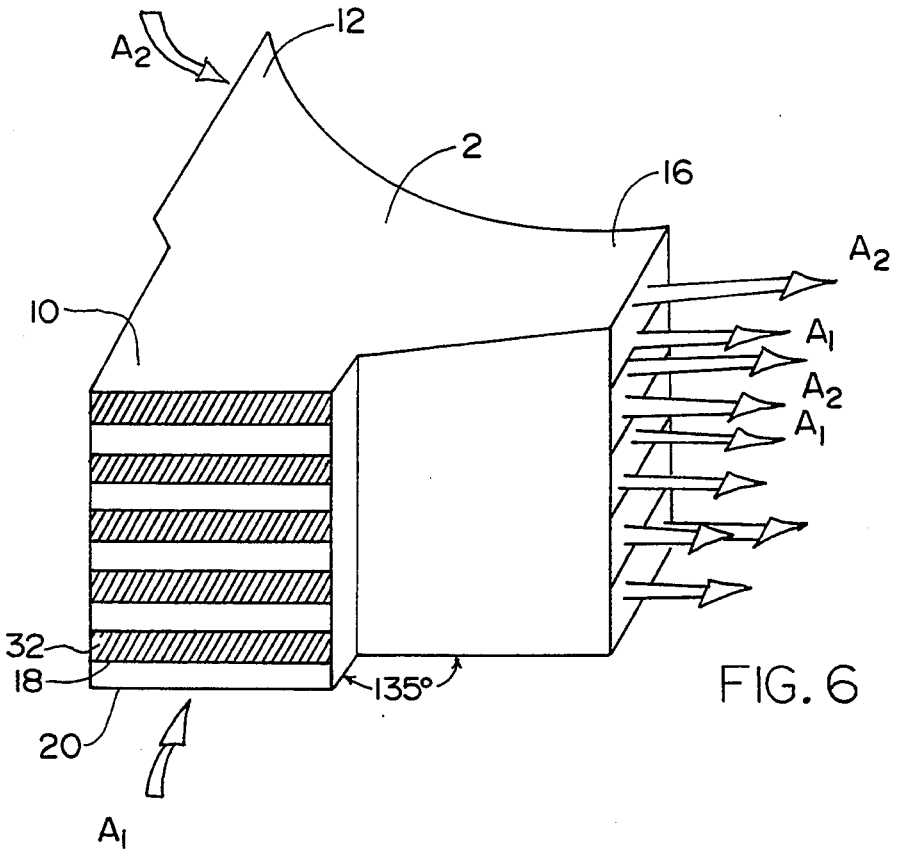
FIG. 6 Side view of preferred "Y" variation with inlet streams at 90° to one another and at 135° to the outlet passage.

In the preferred embodiment in FIG. 6, the two inlet passages 10 and 12 would enter the plenum at about 135° angles with respect to the center line of the outlet passage 16. Starting with the centerline of the outlet duct as 0°, one would measure 135° along a plane parallel to the centerlines of the three passages.

The passageways of inlet ducts 10 and 12 would be at 135° angles with respect to this outlet 16 and are disposed at 90° to one another. They resemble the top portions of a "Y" hence this term for the preferred embodiment. The air stream entering the first inlet 10 is designated A1 and the air stream entering the second inlet 12 is designated A2. These air streams are stratified by the system of louvers (or panels) 18 and fixed walls 20. The stratified layers exit the outlet passage 16 as alternating layers A1, A2, A1, A2, etc.

Note that either recirculated air or fresh air may be A1, these terms A1 and A2 are merely a convention to show the two separate incoming air streams. It is preferred that the curtain be made of flexible metal with fold lines that allow the metal to bend in accordion-like fashion.

Figure 10:
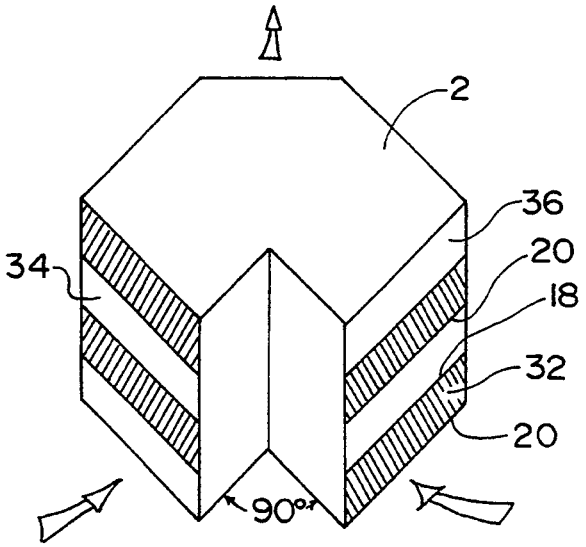
FIG. 10 Rear view of "Y" variation showing both entrance passages.
Figure 11:
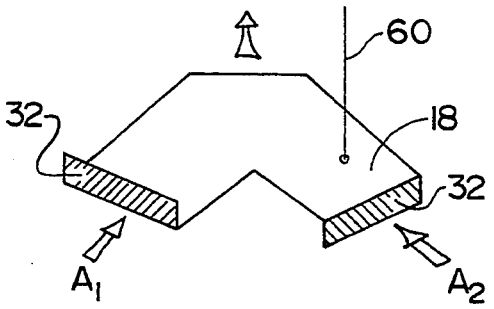
FIG. 11 View of one partition in the "Y" configuration showing curtain at either end.

FIG. 10 shows the view of the two inlet passage in the "Y" configuration. Note that each louver 18 has one end in connection with each inlet. An individual louver is shown in FIG. 11. It is seen that the louver has two curtains 32 attached to it. In this example the curtains are about 90° to one another to correspond to the orientation of the intake passages but this angle could change if the intake passages are oriented at different angles to one another. One curtain is above and one below the plane of the louver. Thus, each louver divides the chamber formed by the walls 20 into two sections above and below one another. One section for each inletted air stream.

It is preferred that the louvers be moved by a series of rods 60 that connect with each louver. In the preferred version, the louvers remain parallel to the walls 20 as they are moved up or down.

It is thought that orienting the intake passages at 135° provides a fairly uniform distribution of the two air streams. Both impinge upon one another at roughly the same angle and thus tend to move across the cross section of the plenum at similar rate of flow. This leads to uniform distribution of each air stream across the width of the plenum.

Figure 7:
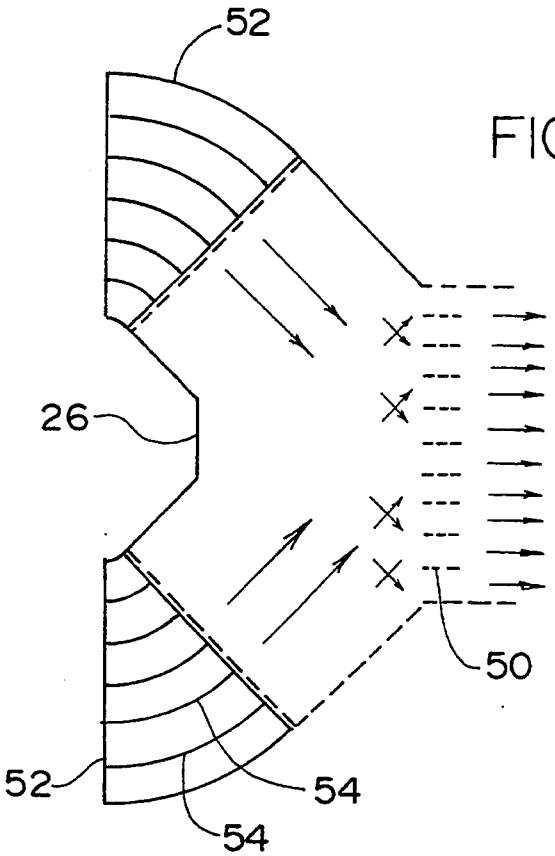
FIG. 7 Top view of FIG. 8 with cutaway to show the vanes of an air cutter or straightener.
Figure 9:
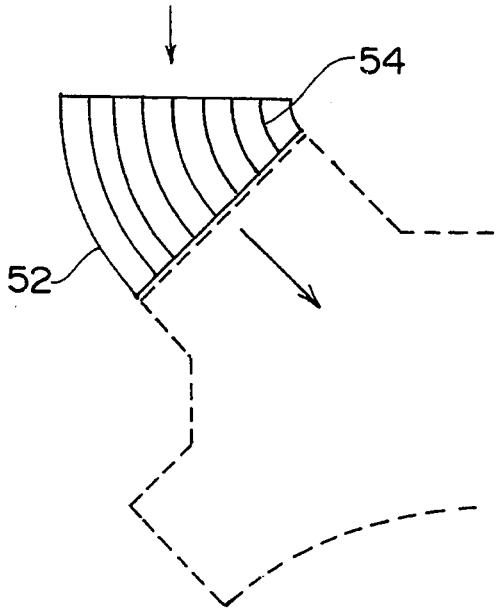
FIG. 9 Top view of adapter with cut away view of air cutter vanes inside.
Figure 8:
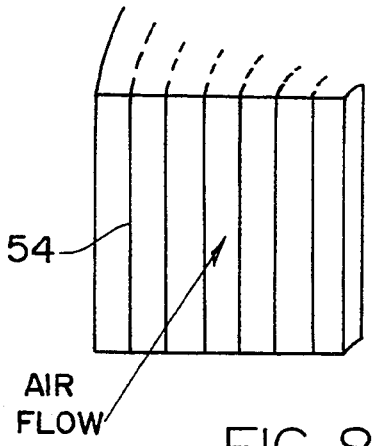
FIG. 8 Detail of direction vanes arranged vertically in the conduit.

The use of the air director or straightener 50 and 52 may be used with either or both inlet ducts. 50 is a straight straightener that may used in straight passageways, e.g. where the air streams meet in the plenum. 52 is a curved director which is used where the passageways bend. Vanes 54 are disposed across the passages in parallel fashion and divide the air streams as shown by the arrows in FIG. 7. The directors insure even distribution of air across the plenum. FIG. 8 shows the cross section of a curved straightener with vanes 54 on the inside. FIG. 9 shows the vanes as seen from above.

These directors may be shaped at various angles in order to take the incoming air ducts, which may be oriented in various angles, and orient them in a "Y" configuration in order to put the air streams in the preferred position for entering the plenum. This leads to optimum air distribution across the plenum.

I claim:

1. A mixing plenum for the distribution of fluid streams having two different inlet sources and for subsequent distribution of said streams comprising: plenum chamber having top and bottom walls and side walls in connection with said top and bottom walls, a set of fixed partitions in connection with said side walls so as to divide said plenum chamber into a plurality of passages that are parallel to one another and extend across said plenum chamber, a first fluid intake means in connection with a portion of said passages and a second fluid intake means in connection with another portion of said passages, said first fluid intake means in connection with a first fluid stream and said second fluid intake means in connection with a second fluid stream, a set of substantially parallel louver panels disposed across said plurality of passages so as to divide each of said passages into an upper and lower passage with one of said fixed partitions above, and one of said fixed partitions below each said parallel louver panel, a set of first curtains each of said first set of curtains in connection with one of said louver panels and said fixed partition above said louver panel so as to block said upper passage from said air streams, a set of second curtains, each of said second set of curtains in connection with one of said louver panels and said fixed partition below said louver panel so as to block said lower passage from said air streams, a connecting means in connection with each of said louver panels so as to move said louver panels simultaneously in order to vary the proportions of said first and second air streams, an outlet duct in connection with said upper and lower chambers so as to disperse said first and second air streams as one air stream.

2. The apparatus of claim 1 wherein said first and second fluid intake passages are disposed at a 135° angle to that of said outlet passage.

3. The apparatus of claim 2 wherein said connecting means comprises a rod disposed vertically in connection with a portion of each of said louver panels.

4. The apparatus of claim 3 having an air straightener in connection with said first and second passages, said air straightener comprising a passage with side walls and a plurality of vanes in connection with said walls and disposed parallel to one another so as to divide said air streams into smaller streams.

* * * * *